United States Patent [19]

Pong

[11] Patent Number: 4,846,723

[45] Date of Patent: Jul. 11, 1989

[54] CORD OUTLET

[76] Inventor: Kuang-Yuan Pong, No. 35, Lane 105, Shi-Dah Road, Hsin Chu, Taiwan

[21] Appl. No.: 225,843

[22] Filed: Jul. 29, 1988

[51] Int. Cl.[4] ..... H01R 13/58

[52] U.S. Cl. ..... 439/456; 439/686

[58] Field of Search ..... 439/456–459, 439/598, 599, 651, 686, 690, 622, 695, 701

[56] References Cited

U.S. PATENT DOCUMENTS

| | | | |
|---|---|---|---|
| 2,196,052 | 4/1940 | Benander | 439/598 |
| 3,031,637 | 4/1962 | Descarries | 439/459 |
| 4,592,613 | 6/1986 | Tong | 439/622 |
| 4,770,647 | 9/1988 | Wu | 439/622 |

FOREIGN PATENT DOCUMENTS

| | | | |
|---|---|---|---|
| 2449343 | 9/1980 | France | 439/456 |
| 0169282 | 10/1951 | German Democratic Rep. | 439/599 |

*Primary Examiner*—Gary F. Paumen

*Attorney, Agent, or Firm*—Morton J. Rosenberg

[57] ABSTRACT

An improved structure of new type cord outlet is formed by an outer shell, an inner socket and a pair of conductor terminal pieces. The two conductor terminal pieces are installed into conductor terminal grooves. The terminal grooves are provided with long flanges which are received within inverted "U" shaped portions of the terminals. Short flanges are also provided to contact the wire crimp portion of the terminals. The wires are folded through a plurality of wire grooves to form a strain relief. The inner socket is provided with hook shaped latch fingers to lockingly mate with wedge shaped projections in the outer shell to form a tight assembled structure. Having the property of being tight, the improved structure of this new type cord outlet is not easily loosened. Thus, providing a durable long lasting device.

1 Claim, 2 Drawing Sheets

CORD OUTLET

BACKGROUND OF THE INVENTION

The current cord outlet on the market is not ideal. It consists of a socket with retention grooves at both inner sides with two wedges at the side walls of the grooves and a "V" type connector terminal on the conductors. The "V" type connector, however, can not be fixed firmly and will become loose after some usage.

In view of the above-mentioned problem, the instant invention has been developed to provide an improved structure for a new type of cord outlet that provides the advantages of conventional commercially available tail outlets without having the aforemention problems.

The instant invention relates to an improved structure for a new type of cord outlet. It consists of an outer shell, an inner socket and conductor terminal pieces. The inner socket is lockingly coupled to the outer shell by two hook shaped latch fingers located at the rear of the inner socket which engage two wedge shaped projections located at the inner rear portion of the of the outer shell. This structure provides a much tighter assembly for the cord outlet and the power supply wire. The assembly can be used for a long period of time without becoming loose or separating from the drag force of repeated unplugging from the mating connector by pulling the conductor wires.

SUMMARY OF THE INVENTION

An improved structure for a new type cord outlet is provided. This new type of cord outlet includes an outer shell, an inner socket and conductor pieces. The inner socket is lockingly coupled within the cavity formed by the molded outer shell, by two hook shaped latch fingers located at the rear of the inner socket which engages two wedge shaped projections located at the inner rear portion of the outer shell. This structure assures that the inner socket is fixedly coupled to the outer shell tightly. There are grooves provided for putting the conductor terminal pieces and the conductor wire in the inner socket. There is also a flange with slotted openings formed therethrough at the front of the inner socket for connecting the plug from an appliance.

DESCRIPTION OF THE PREFERRED EMBODIMENTS

Figure 1:
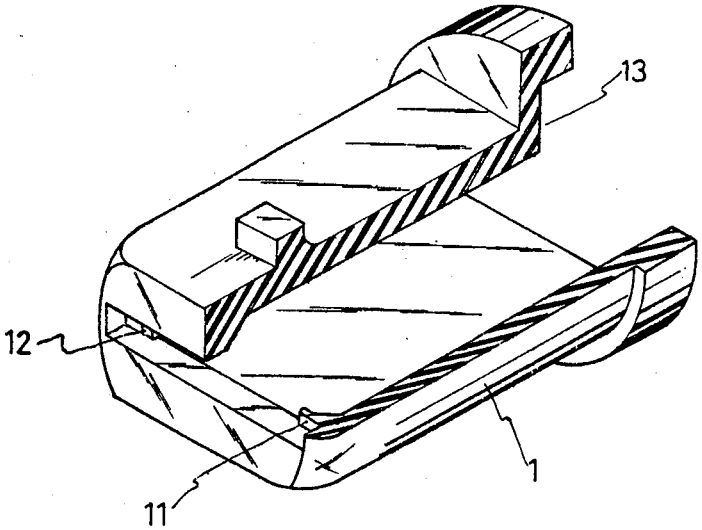
FIG. 1 is a cross-sectional view of the outer shell of the present invention.
Figure 2:
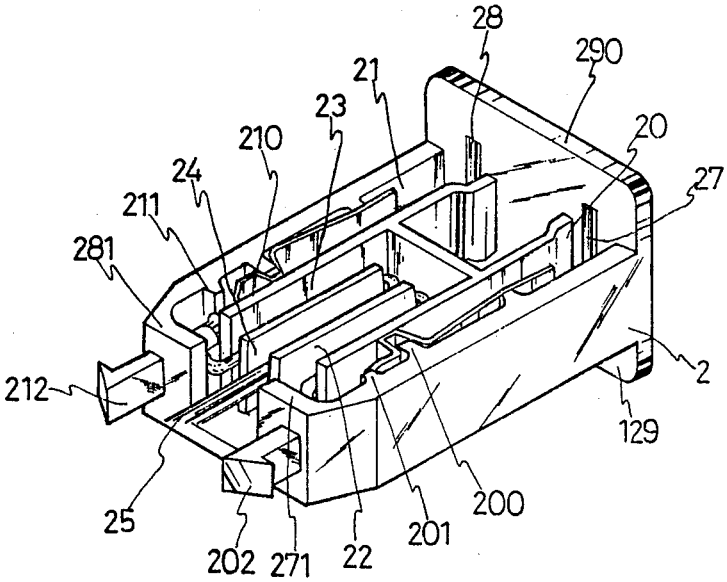
FIG. 2 illustrates the structure of the inner socket of the present invention; and, FIG. 3 illustrates the interior structure of the present invention.
Figure 3:
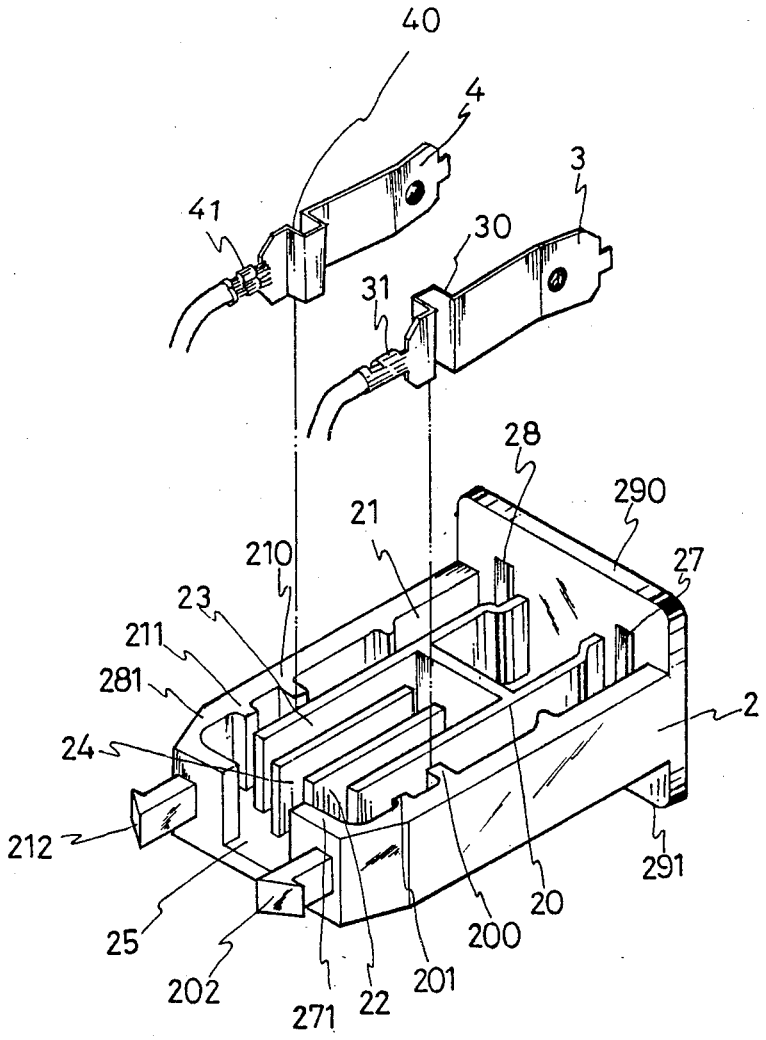

Referring now to FIGS. 1–3, there is shown a new type of cord outlet assembly constructed according to the inventive concept. The assembly consists of an outer shell, an inner socket and at least a pair of conductor terminal pieces. The conductor terminal pieces are each put in a corresponding groove formed in the inner socket and fixedly held by both a long flange and a short flange projecting from the corresponding side wall of the socket. The main purpose of this structure is to provide good contact performance. There are also three grooves formed in the inner socket which are provided to form a strain relief for the conductor wires which connect with the conductor terminal pieces to prevent the wires from becoming loose or separated from the terminals when the wires are pulled to unplug the connection.

As shown in FIGS. 1–3, the tail outlet according to the inventive concept consists of an outer shell 1 having wedge shaped projections 11 and 12 at one end, an inner socket 2, and conductor terminal pieces 3 and 4. The inner socket 2 includes long flanges 200 and 210, short flanges 201 and 211, conductor terminal grooves 20 and 21, parallel wire grooves 22, 23 and 24, latch fingers 202 and 212 and outlet holes 27 and 28.

The outer shell 1 is a one piece molded hollow shell body which has two wedge shaped projections 11 and 12 for fixedly coupling inner socket 2, located at rear end of shell 1. Outer shell 1 is also provided with two notches 13 and 14 (not shown in the figure) located at front edge along the top and bottom sides of outer shell 1 for receiving inner socket 2 to form a smooth front end surface for the assembled combination of outer shell 1 and inner socket 2.

The inner socket 2 is a one piece molded shell body which is formed with conductor terminal grooves 20 and 21 for receipt of conductor terminal pieces 3 and 4, respectively. The conductor terminal pieces 3 and 4 are made from copper strips with good conductivity. Each terminal has an inverted "U" shaped portion 30 and 40 located at the rear portion of the copper strip for fixation within the inner socket 2. At the rear of terminals 3 and 4 a flanged crimping portion 31 and 41, respectively, is provided.

Inner socket 2 is provided with two long flanges 200 and 210, and two short flanges 201 and 211 projecting from opposing outer side walls of the conductor terminal grooves 20 and 21. Long flanges 200 and 210 are received within the respective inverted "U" shaped portions 30 and 40 of terminals 3 and 4. Short flanges 201 and 211 each projecting from opposing outer side walls of the conductor terminal grooves 20 and 21, adjacent long flanges 200 and 210, respectively, bear against respective crimping portion 31 and 41 of terminals 3 and 4. The crimping portions 31 and 41 provide the means to interconcect the conductor wires to the terminals.

The conductor wires, each connected to a respective terminal 3, 4, exit the respective terminal groove 20, 21 at the rear end 271, 281, passing toward the front of inner socket 2 through wire groove 22, 23. The wires each reverse direction at the forward end of wire groove 22, 23 and pass toward the rear of inner socket 2 through wire groove 24, thus defining a serpentine path to provide a strain relief for the conductor wire-erminal connection. The conductor wires exiting wire groove 24 pass through notch 25 located between the two hook shaped latch fingers 202 and 212, each extending from the outer surface of respective end wall portions 291 and 281 of inner socket 2.

There are two outlet holes 27 and 28 which pass through the front face of inner socket 2 for receiving a mating plug connector. The outlet holes 27 and 28 pass through the front face, formed by flanges 290 and 291, to the respective conductor terminal grooves 20 and 21 to allow the connector pins of the mating plug to make electrical contact with the conductor terminal pieces 3 and 4. This contact by the mating connector pins will cause the conductor terminal pieces 3 and 4 to be pressed toward the outer wall of respective terminal grooves 20 and 21 which is resisted by the long flanges 200, 210 and the short flanges 210, 211 to provide sufficient contact pressure for a good electrical connection. This kind of connection provides good contact capability and long service life for the outlet structure embodying the invention concept.

The outlet is assembled by:

1. Inserting the assembled inner socket 2 into the outer hollow shell body 1 from front to back.

2. Engaging the latch fingers 202 and 212 of inner socket 2 with the wedge shaped projections 11 and 12, respectively, of outer shell 1.

3. Flanges 290 and 291 of inner socket 2 are received within notches 13 and 14 of outer shell 1 to form a smooth surface at the front end of the outlet.

The improved structure of new type cord outlet is ideal for the connection between the cord outlet and the conductor wires, as a strain relief is integrally formed therein.

What is claimed is:

1. An improved cord outlet assembly coupled to a pair of conducting wires, the improvement comprising:

a one piece molded outer shell having a cavity formed therein and a pair of wedge shaped projections formed at one end and a pair of notches formed on an opposing end thereof;

a one piece molded inner socket having a pair of hook shaped latch fingers extending from one end thereof for lockingly engaging said wedge shaped projections subsequent to said inner socket being inserted within said outer shell cavity, said inner socket further having a notch formed in an end wall positionally located intermediate said pair of hook shaped latch fingers, said inner socket having a pair of terminal receiving grooves integrally formed therein, each of said terminal receiving grooves having both a long flange and a short flange extending from one wall thereof;

a pair of conductor female terminal members formed from a copper material composition, each of said conductor terminal members having an inverted "U" shaped portion to receive said long flange for retaining said conductor terminal member within a respective said terminal receiving groove and a coupling portion for electrical connection to a respective one of said conducting wires;

strain relief means integrally formed on said inner socket for substantially preventing pulling force applied to said conducting wires from straining said electrical connection between said conducting wires and said conductor terminal members, said strain relief means including a plurality of grooves forming a serpentine path through which said conducting wires pass.

* * * * *